US008641591B2

(12) United States Patent
Wetsch et al.

(10) Patent No.: US 8,641,591 B2
(45) Date of Patent: Feb. 4, 2014

(54) CENTER-FED DUNNAGE SYSTEM

(75) Inventors: Thomas D. Wetsch, St. Charles, IL (US); Robert Tegel, Huntley, IL (US)

(73) Assignee: Pregis Innovative Packaging, Inc., Deerfield, IL (US)

( * ) Notice: Subject to any disclaimer, the term of this patent is extended or adjusted under 35 U.S.C. 154(b) by 406 days.

(21) Appl. No.: 12/869,498

(22) Filed: Aug. 26, 2010

(65) Prior Publication Data

US 2012/0053040 A1 Mar. 1, 2012

(51) Int. Cl.
*B31B 1/00* (2006.01)

(52) U.S. Cl.
USPC ..... 493/464; 493/354; 493/407; 493/967

(58) Field of Classification Search
USPC ..... 493/352, 407, 464, 354, 967
See application file for complete search history.

(56) References Cited

U.S. PATENT DOCUMENTS

| | | | | |
|---|---|---|---|---|
| 2,786,399 | A | 3/1957 | Mason et al. | |
| 3,650,877 | A | 3/1972 | Johnson | |
| 4,699,609 | A | 10/1987 | Komaransky et al. | |
| 5,131,903 | A | 7/1992 | Levine et al. | |
| 5,188,581 | A | 2/1993 | Baldacci | |
| 5,301,889 | A * | 4/1994 | Ball | 242/564.4 |
| 6,106,452 | A * | 8/2000 | Baumuller | 493/464 |
| 6,632,165 | B1 | 10/2003 | Letourneau et al. | |
| 6,695,247 | B2 | 2/2004 | Widlund | |
| 6,981,352 | B2 | 1/2006 | Chow et al. | |
| 7,066,422 | B1 | 6/2006 | Slocum | |
| 7,083,560 | B2 | 8/2006 | Kobben | |
| 7,407,471 | B2 | 8/2008 | Demers | |
| 7,479,100 | B2 | 1/2009 | Toth | |
| 7,585,268 | B2 | 9/2009 | Cheich | |
| 7,651,455 | B2 | 1/2010 | Yampolsky et al. | |
| 7,744,519 | B2 | 6/2010 | Wetsch et al. | |
| 7,771,338 | B2 | 8/2010 | Wetsch et al. | |
| 2003/0073558 | A1 | 4/2003 | Chesterson et al. | |
| 2007/0066472 | A1 | 3/2007 | Harding | |
| 2007/0117703 | A1 | 5/2007 | Cavaliere et al. | |
| 2008/0076653 | A1 | 3/2008 | Shaw et al. | |
| 2008/0261794 | A1 * | 10/2008 | Slovencik | 493/370 |
| 2009/0023570 | A1 | 1/2009 | Kung et al. | |
| 2009/0026306 | A1 | 1/2009 | Kempster et al. | |
| 2010/0029456 | A1 | 2/2010 | Cheich | |

FOREIGN PATENT DOCUMENTS

| | | |
|---|---|---|
| FR | 2667854 | 10/1990 |
| WO | WO 2008/030743 | 3/2008 |

OTHER PUBLICATIONS

International Search Report for International Patent Application No. PCT/US2011/049158—2012.

* cited by examiner

*Primary Examiner* — Thanh Truong
(74) *Attorney, Agent, or Firm* — Dorsey & Whitney LLP

(57) ABSTRACT

A dunnage system for processing material into dunnage is herein described. A converting station of the system can include a drum having a drum surface first and second axial sides and guides protruding adjacent the drum surface on the first and second axial sides associated with the drum to rotate with the drum surface. A supply gripping member can be provided to grip a supply roll, and can include a rotatable base. A pivotal blade can be used to cut the dunnage.

27 Claims, 6 Drawing Sheets

CENTER-FED DUNNAGE SYSTEM

FIELD

A dunnage system for processing material into dunnage is herein described.

BACKGROUND

Products to be transported and/or stored often are packed within a box or other container. In many instances, however, the shape of the product does not match the shape of the container. Most containers utilized for transporting products have the general shape of a square or rectangular box and, of course, products can be any shape or size. To fit a product within a container and to safely transport and/or store the product without damage to the product, the void space within the container is typically filled with a packing or cushioning material.

The protective-packing material utilized to fill void space within a container is often a lightweight, air-filled material that may act as a pillow or cushion to protect the product within the container. Many types of protective packaging have been used. These include, for example, foam products, inflatable pillows, and paper dunnage.

In the context of paper-based protective packaging, rolls of paper sheet are crumpled to produce the dunnage. Most commonly, this type of dunnage is created by running a generally continuous strip of paper into a machine and then cutting the crumpled sheet material into a desired length to effectively fill void space within a container holding a product. A dunnage conversion machine thus converts a compact supply of stock material, such as a roll or stack of paper, into a lower density dunnage material as the dunnage material is needed by the packer. Exampled of cushioning product machined that feed a paper sheet from an innermost location of a roll are described in U.S. Patent Publication Nos. 2008/0076653 and 2008/0261794.

SUMMARY

In a preferred embodiment, a dunnage system for converting sheet material can include a converting station, which has a drum having a drum surface first and second axial sides. Guides can be provided protruding adjacent the drum surface on the first and second axial sides associated with the drum to rotate with the drum surface, and configured for guiding the sheet supply material onto the drum surface. A driving mechanism can be associated with the drum for rotating the drum. A roller may be provided biased against the drum, such as by a magnetic retaining mechanism, between the guides to grip the sheet material against the drum for pulling and converting the sheet material to provide dunnage material.

The diameter of the drum can be greater than a diameter of the roller, and the guides can have a height above the drum surface of at least a tenth of the drum diameter. Preferably, the guide heights are at least about the radius of the roller and are convexly dished with respect to the drum surface.

An embodiment has a supply station configured for positioning a supply roll of the sheet material with respect to the converting station such that the sheet material is fed to the converting station coiled from inside the roll. The supply station is preferably positioned and configured to feed the coiled sheet material upwards to the converting station. The drum and roller can be configured for flattening and pulling the coiled supply material to provide the dunnage material. Additionally, the supply station can have a gripping member configured for engaging and gripping the outside of the supply roll for retaining the supply roll as the sheet material becomes depleted. In an embodiment, the gripping member includes a barb configured to engage the outer surface of the supply roll, such that the outer surface can be pulled away from the barb when the roll is empty. The barb can be flexible for automatically engaging the outer surface of the supply roll as the supply roll is positioned in the supply station. The supply roll can be enclosed in an outer wrapping, with the gripping member configured for engaging the outer wrapping.

The supply station can be provided with a supply base configured for supporting the supply roll and for allowing the supply roll to rotate axially as the sheet material is pulled therefrom. The supply base can be substantially freely rotatable to rotate with the supply roll, and a supply brake can be associated with the supply base for applying a resistance to the rotation of the supply roll for controlling the unwinding of the coiled sheet material.

A cutting station can be provided downstream of converting station and can include a pivotable blade configured to swivel as it cuts through the dunnage material. A blade actuator can be provided for actuating the blade for cutting the dunnage material, preferably with the blade is resiliently biased on towards an initial pivotal position.

DETAILED DESCRIPTION

Figure 1:
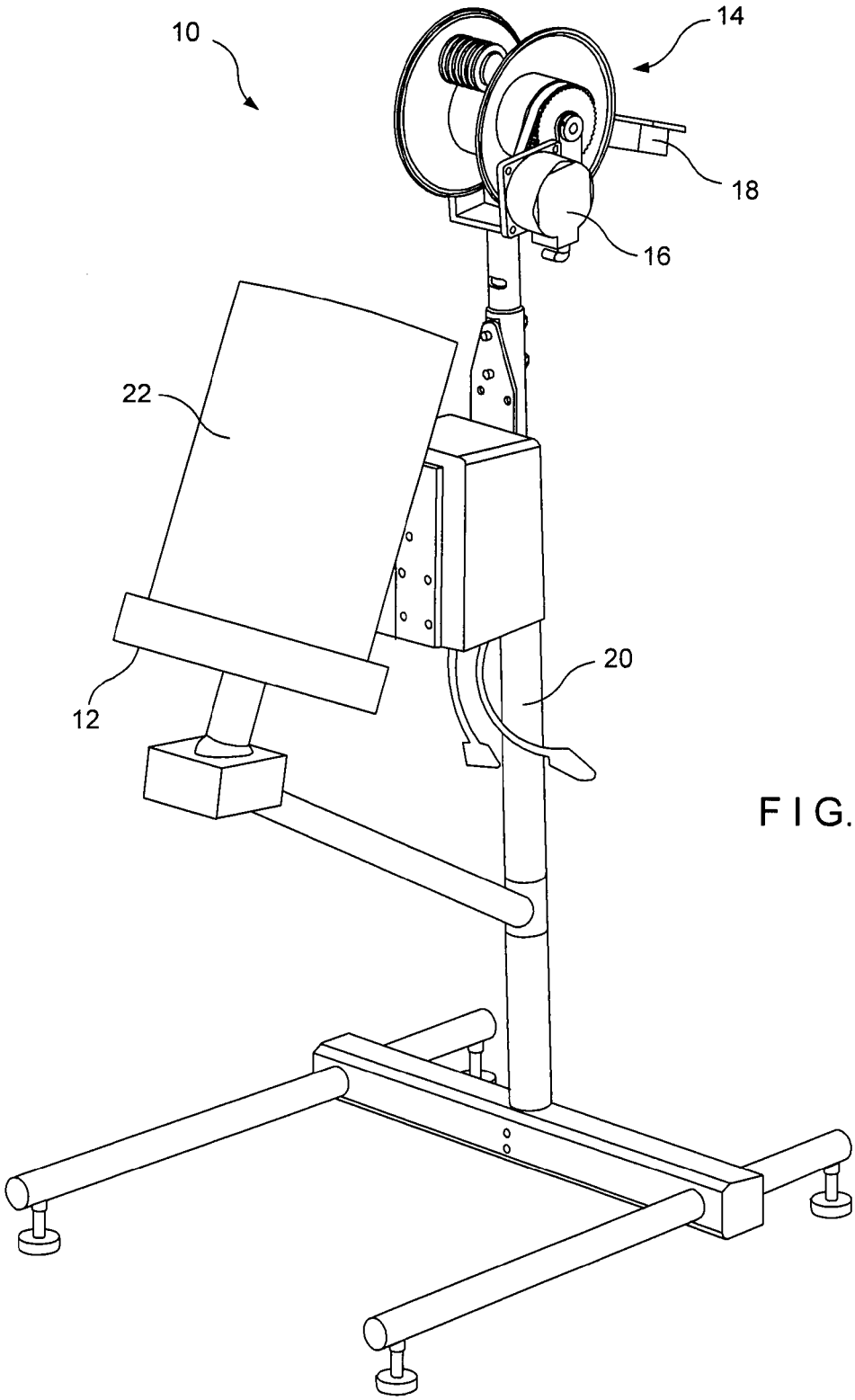
FIG. 1 is a perspective view of a dunnage system in accordance with one embodiment.
Figure 3:
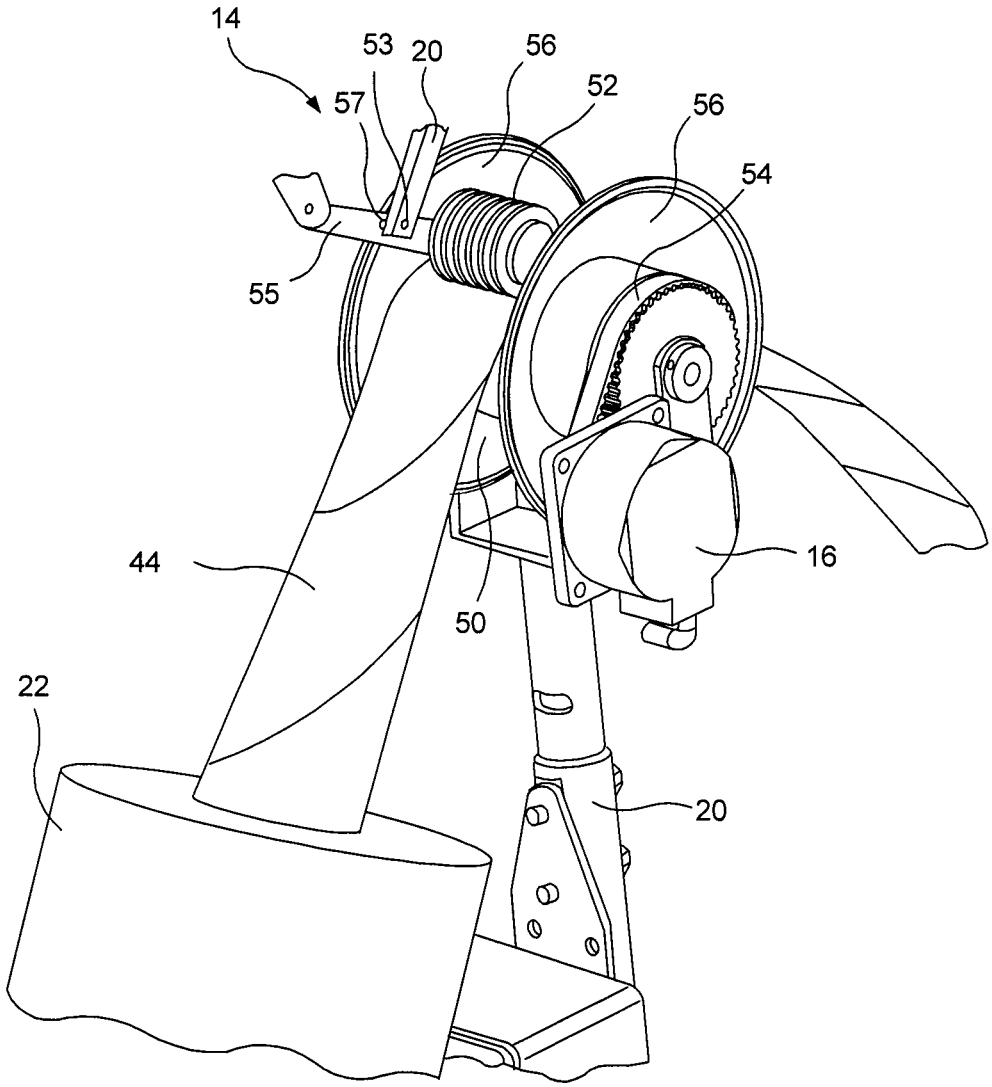
FIG. 3 illustrates a close up view of the converting station thereof.

The dunnage system provided herein may be used to process sheet material, such as a roll of paper, into dunnage. Commonly, the unprocessed material type may be pulp based virgin and recycled papers, newsprint, cellulose and starch compositions, and poly or synthetic material, of suitable thickness, weight, and dimensions FIG. 1 illustrates the dunnage system 10 in accordance with one embodiment. As shown, the dunnage system 10 includes a supply station with a supply support 12, a converting station 14, including driving mechanism, such as a motor 16, and a cutter 18. The supply support 12 and the converting station 14 are provided on a frame 20. Generally, the frame 20 may be formed of steel, aluminum, another metal, a composite, or any other suitable material. In some embodiments, the cutter 18 may also be provided on the frame 20. A sheet supply 22 is shown positioned on the supply support 12. The supply support 12, the sheet supply 22, and the converting station 14 are oriented with respect to each other such that sheet material is drawn generally upwardly from the sheet supply 22 to the converting station 14, although alternative orientations can be employed. In other embodiments, for example, sheet material may be drawn generally laterally or downwardly from the supply to converting station. Further, in the embodiment of FIG. 1, the created dunnage is generally directed through the converting station 14, and downwardly and forwardly by a cutter 18, as shown in FIG. 3. In other embodiments, the created dunnage may exit the device in other directions.

Figure 2:
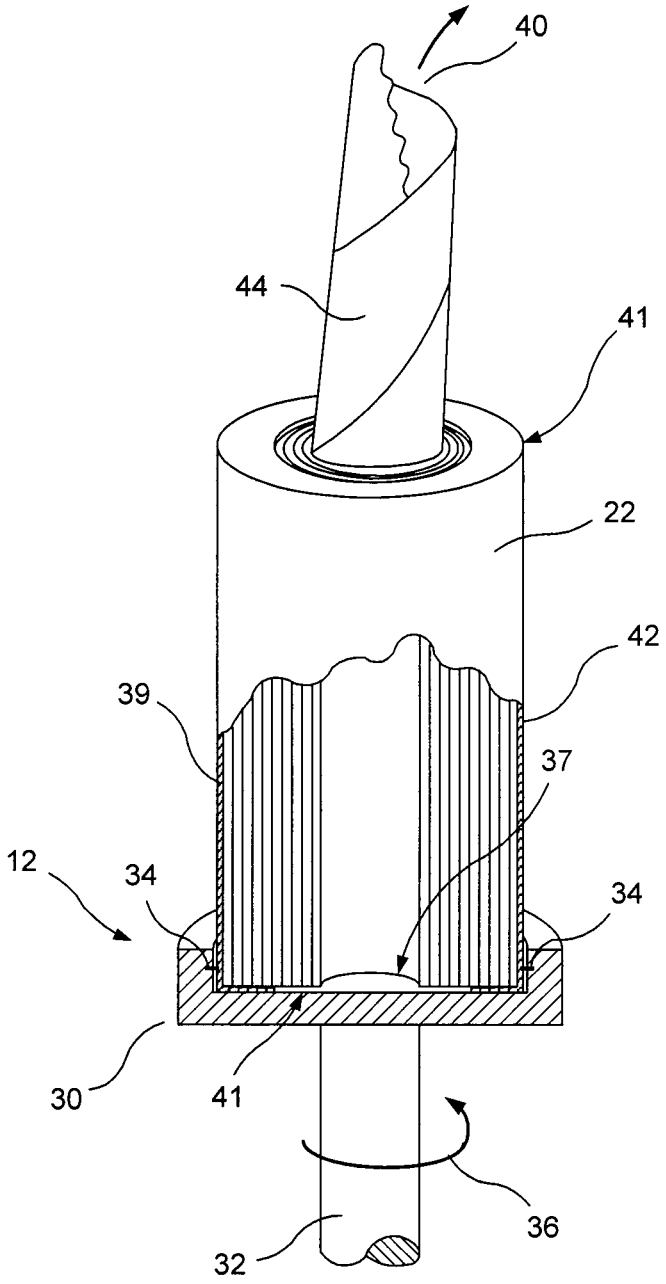
FIG. 2 illustrates a close up view of the supply support thereof.

Referring to FIG. 2, the preferred embodiment of support 12 includes a roll base 30, supported on support structure 32, and a gripping member 34. A supply roll 22 of sheet material can rest on the base 30. Specifically, the roll base 30 may include a roll-receiving space 37 in which the supply roll 22 may be accommodated. The support structure 32 in this embodiment is configured to allow the supply roll 22 to rotate axially. This can be accomplished by allowing the supply roll 22 to rotate with respect to the base 30, or by allowing the base 30 and/or its support structure 32 to rotate as indicated by arrow 36. Preferably, free rotation of the supply roll 22 is allowed, and such rotation can optionally be regulated such as by providing a brake or other mechanism to provide a resistance to the rotation, such as a frictional element. In another embodiment, the rotation may be driven, such as by a motor. In yet another embodiment, however, the roll base or other support for the supply roll 22 is non-rotatable and can be in a fixed position, such as to hold the supply roll in a fixed position, with respect to the converting station.

One or more gripping members 34 can be provided to positively hold the supply roll 22 to the base 30. In one embodiment, the gripping members 34 comprise barbs, for example that are directed towards the roll to grip the outer surface thereof, so that the supply roll 22 can be held as the sheet material is depleted therefrom. Alternative gripping members include high-friction or traction surfaces, for instance. In one embodiment, the supply roll 22 is provided on the base 30 in a naked or unwrapped state. In a more preferred embodiment, the supply roll 22 is provided with an outer wrapping, such as a plastic shrink-wrap 39 or other packaging extending around the roll 22, and preferably closely fitting about the roll, containing the roll, keeping it wound, and facilitating transportation thereof. The shrink wrap 39 can have an opening 41 on an axial end to allow the sheeting material, such as paper, from the supply roll 22 to be removed from the center thereof. A second opening 41 can be provided at the opposite axial end of the supply roll 22 so that the roll can be positioned with either end facing the converting stage 14.

The preferred barbs 34 in this embodiment extend inwardly towards the roll-receiving space 37 in the base 30 in which the supply roll is received, and can be flexible to automatically engage the supply roll 22 and grip it onto the base 30 when the supply roll 2 is placed on the base 30 or inserted into the roll-receiving space 37. The barbs can be sharp to at least partially penetrate the outer surface of the supply roll 22. The angle and flexibility of the barbs can be selected o facilitate this capture of the supply roll 22 and its retention. Preferably, the barbs are configured to capture and retain the shrink wrap 39 or other packaging, while allowing the paper of the supply roll 22, including outermost paper layer on the supply roll 22, to be pulled out therefrom, such as linearly, by the converting mechanism 14. After the paper from the supply roll 22 is emptied, the empty shrink wrap 39 can easily be removed from the barbs 34 and the base 30. Alternative embodiments can have barbs or other gripping members that are selectively engageable and disengageable, and/or that can grip one or more paper layers on the supply roll 22 itself.

Figure 4:
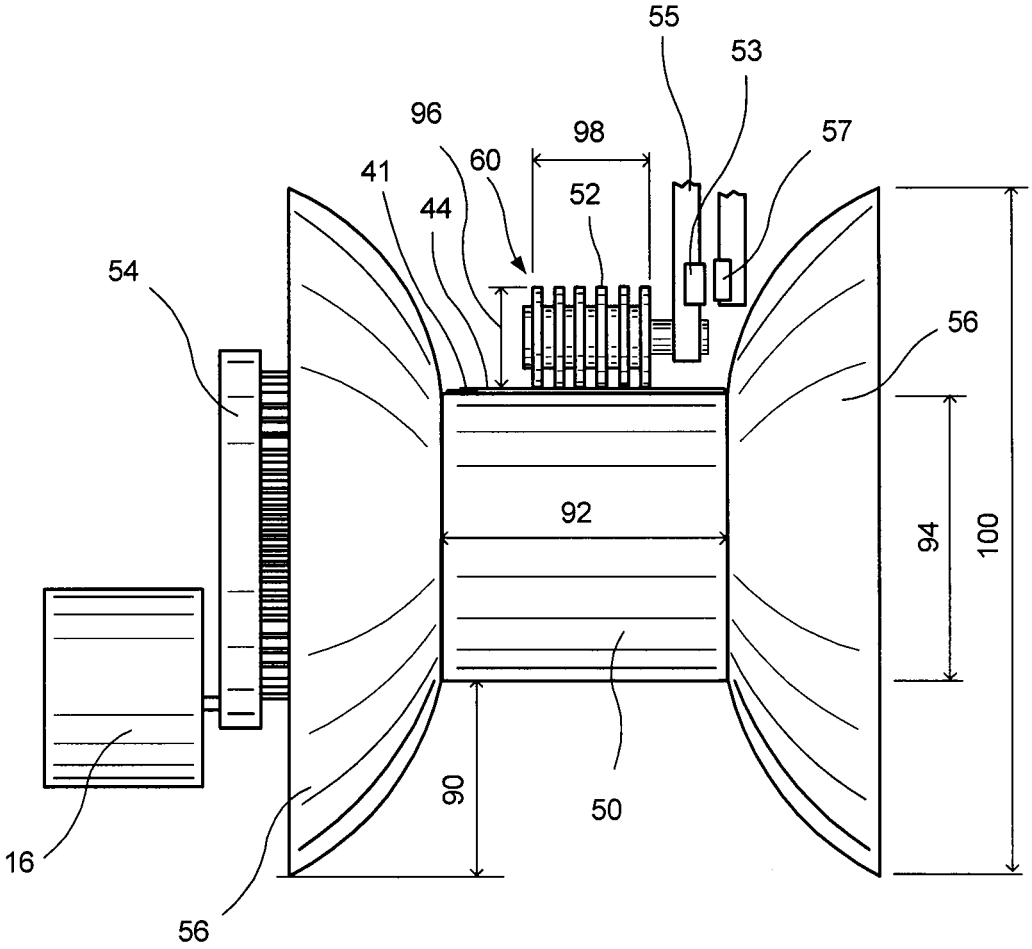
FIG. 4 is a front view of the converting station thereof.

Referring to FIGS. 2-4, sheet material from the supply roll 22, standing on its end in the base 30, is drawn from inside the supply roll 22. A first end 40, drawn from a radially innermost location in the roll 22, has been pulled from the roll 22 and introduced into the converting station 14. A second end 42 at a radially outermost location, held in place by the shrink wrap 39. As the paper is withdrawn from the innermost location from roll 22, it twists about a longitudinal axis as a helix, forming a tube or coil 44, such as with the lateral edges of the sheet material meeting or overlapping in the coil.

The converting station 14, shown particularly in FIGS. 3 and 4, includes drum 50 that is driven to draw the coil 44 through the converting station 14. Preferably, a roller 52, which can be a smaller drum, is provided cooperating with, and preferably positioned and biased against, the drum 50 to grip the coil 44 and pull it along a feed path through the converting station 14. The size, position, and motion of the roller 52 in relation to the drum 50 can be selected such that the small roller creases the sheet material of the coil 44 as is bunches up ahead of the location where it is pinches between the roller 52 and drum 50, or laterally on the sides thereof. This creasing can help retain the flattened shape of the produced dunnage material. Alternative embodiments do not employ such creasing.

During the pulling of the coil 44 between the drum 50 and roller 52, the roller The converting station includes an infeed end, an outfeed end, and a feed path generally extending from the infeed to the outfeed. The drum 50 and roller 52 together help define the feed path. The drum 50 and roller 52 are preferably configured and associated with each other to also flatten the coil to provide a flattened tube of paper dunnage-material at the output side of the device. When removed from the system 10, such flattened tube can be rolled over itself, such as about an axis generally parallel to the tube's lateral axis, and coiled to provide 3-dimensional dunnage to fill voids in a package to provide protective packaging for an item that is to be shipped within a box or other container.

The large drum 50 can be driven, for example, by motor 16 or another motive device. In alternative embodiments, the roller 52 is driven in addition to or instead of the drum 50, although in the preferred embodiment it is unpowered and free to roll due to its engagement against the drum 50. In the embodiment shown, the motor 16 drives the large drum 50 using belt 54.

The roller 52 can be associated with the large drum in any suitable manner including, biased thereagainst by gravity or a spring. In the preferred embodiment, the roller 52 is held in place against the drum 50 by a magnetic retaining mechanism. The magnetic retaining mechanism can include, for example, a first magnetic member 53 mounted with the roller, such as a magnet or ferrous member mounted to a support arm 55 that pivots or otherwise moves to place the roller 52 against the drum 55 and allow it to be pushed away therefrom, and a second magnetic member 57 mounted to the frame 20. The first magnetic member 53 is magnetically coupled, such as by magnetic attraction, to the second magnetic member 57 sufficiently to require a predetermined force tending to separate the roller 52 from the drum 50 to overcome the magnetic coupling. This can occur, for example, if a paper jam occurs between the roller 52 and the drum 50. Once the magnetic coupling is overcome, the bias of the roller 52 towards the drum 50 is decreased or eliminated, facilitating removal of the jam or simply opening the device for servicing.

The diameter 94 of the drum 50 is preferably greater than the diameter 96 of the roller 52. In some embodiments, the axial width 92 of the drum 50 is greater than the width 98 of the roller 52, preferably the roller 52 width is between ¼, ⅓, or ½ and about the width 92 of the drum 50, although smaller or larger sizes can be used. In some embodiments, the roller 52 may have an approximately 2 inch diameter 96 and an approximately 2 inch width 98. In some embodiments, the drum 50 may have an approximately 4-5 inch diameter 94 and an approximately 4 inch width 92. Spaces 60 can be provided on opposite sides of the roller 52 to accommodate the lateral edges of the coil 44 being pulled through the converting stage 14. The drum 50 and/or the roller 52 may be provided with a smooth outer surface or other textures or shapes depending on the material to be gripped, and can have ridges, as shown for the roller 52.

The large drum 50 is preferably provided with one or two guides 56 on each axial side of the drum 50 for guiding the sheet material towards the center of the drum. The guides 56 can be rotationally fixed to the drum 50, and can extend therefrom as flanges, and preferably rotate with the drum 50. In some embodiments, the guides 56 can have dished sides, such as convex when viewed from the surface of the drum 50 that engages the coil 44 in the converting stage 14. In some embodiments, the guides 56 may have a bowl structure. In other embodiments, the guides 56 can have other shapes, such as having a conical structure or being primarily planar flanges, optionally with bent or curved outer edges. Generally, walls of the guides 56 may be provided at an angle to the drum 50 such that the guides extend from the drum at more than 90° but less than 180° from the drum 50. In some embodiments, the angle of the guide 56 starts at the drum 50. In other embodiments, the guides include a planar, or straight-sided conical portion extending from the drum, and preferably transitioning into a shallower angle or a curved surface. The radial height 90 of the guides 56 above the drum surface is preferably between about 1/10 of the width 92 of the drum 50 to about 1/2, one time, or twice the width 92 of the drum 50, and the diameter 100 of the guides 56 are preferably between 1 1/10 and 3 times the diameter 94 of the drum, and preferably about 1.5 to 2.5 times the diameter 94. The guides are preferably generally axially symmetrical to continue to guide and direct the coiled tube 44 onto the drum 50 as the drum rotates. Preferably, the guides 56 are at least a third of more preferably at least a half of, and most preferably taller than the roller 52.

The drums may be formed of any suitable material. In some embodiments, the drums may be provided in a combination of selective surfaces ranging from hard to soft and smooth to rough. In some embodiments, the drums comprise a medium to hard durometer elastomeric and metallic and/or plastic mating drums.

Figure 5:
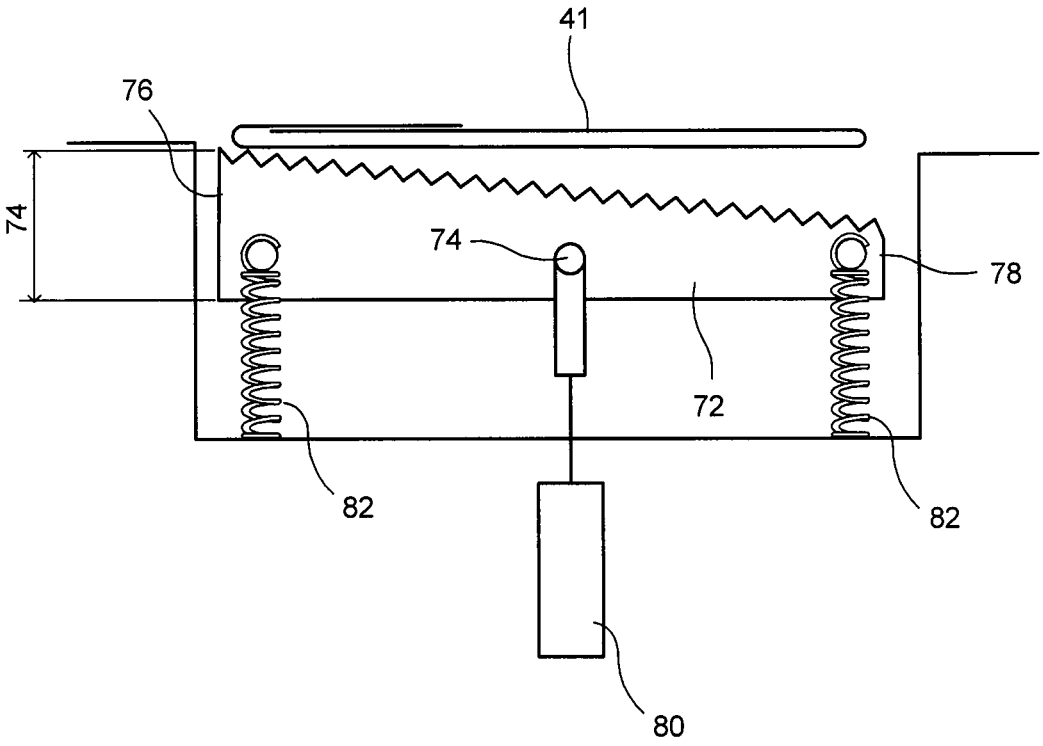
FIG. 5 illustrates a front view of the cutter of a dunnage system in accordance with one embodiment.
Figure 6:
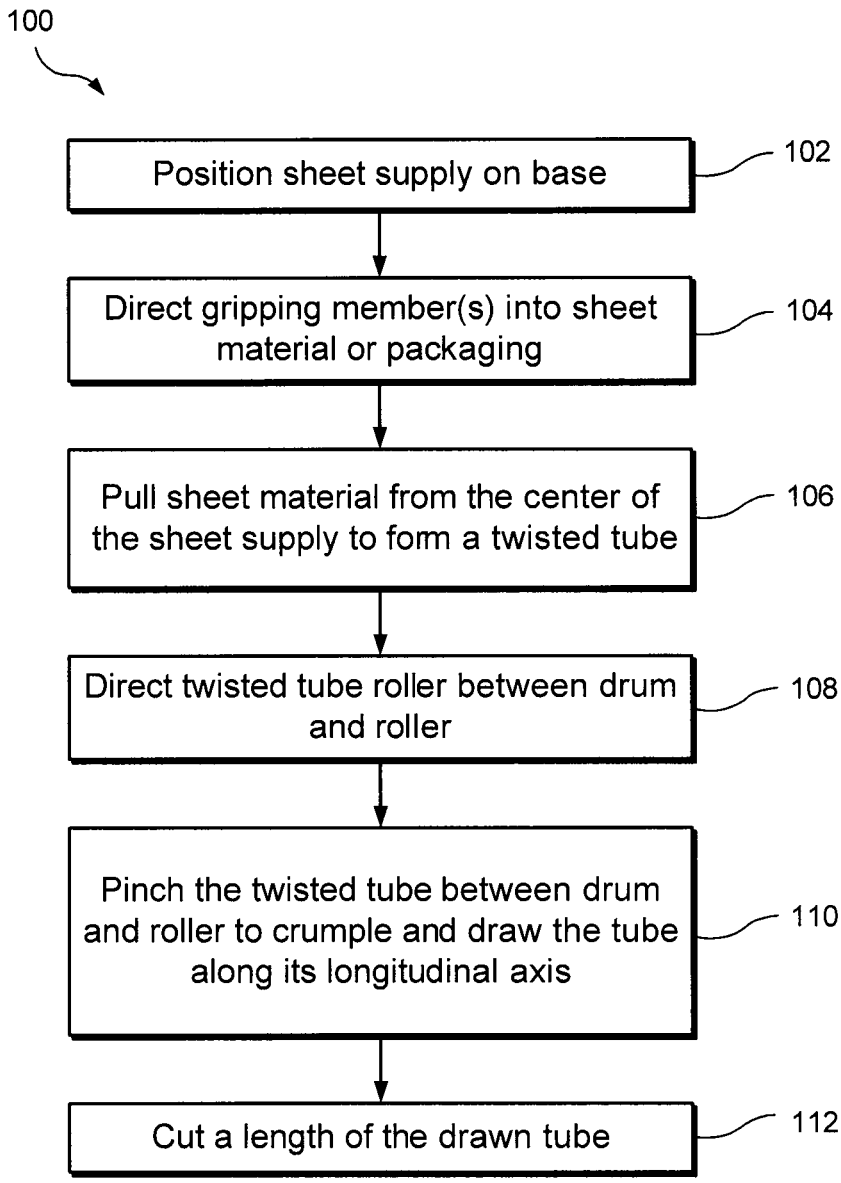
FIG. 6 illustrates a method of forming dunnage in accordance with one embodiment.

FIG. 5 illustrates a close up view of the cutting station 70 of a dunnage system in accordance with one embodiment. The preferred cutting station 70 includes a cutter for cutting the formed dunnage at desired length of coil. In one embodiment, the cutter includes a blade 72, although other suitable cutting, tearing, or other severing members can be used to sever the length of dunnage from the rest of the coiled tube 44. The blade 72 of the embodiment shown is serrated and is mounted to pivot or otherwise swivel, such as about pivot 73 as it cuts through the tube 44 of formed dunnage downstream from the converting station 14. One or more spring elements 82 can be used to preposition the blade in a desired orientation in which it will make initial contact with the tube 44, yet allow the blade to pivot as it cuts through the tube 44.

Preferably, one side 76 is higher than the other 78 to start contacting the tube 44 on one side thereof. The blade 72 is biased as it cuts by the tube 44 to cause the blade to rotate around its pivot 73, and this rotation of the blade can assist in cutting through the tube as it adds a rotational and/or a horizontal (generally parallel to the flat sides of the tube 44) component of motion of the blade. This motion can decrease the force to cut through the tube 44 and can provide a sliding contact between the serrations and tube 44 due to the rotation and/or horizontal movement.

The blade 72 can be operably coupled to an actuator 80 to push the blade against and through the tube 44, although in other embodiments, the tube 44 may be pulled against the blade 72 by its end, or the side of the tube 44 can be pushed thereagainst by another member disposed on an opposite side of the tube 44 from the blade 72. The actuator 80 can act, for example, directly on the pivot 73, and can include a motor, a linear actuator, or another suitable powered device. Alternatively, the blade 72 may be operated manually. Springs 82 return the blade 72 to its original position. Some embodiments do not include a cutting mechanism.

One having ordinary skill in the art should appreciate that there are numerous types and sizes of dunnage for which there can be a need or desire to accumulate or discharge according to an exemplary embodiment of the present invention.

As used herein, the terms "top," "bottom," and/or other terms indicative of direction are used herein for convenience and to depict relational positions and/or directions between the parts of the embodiments. It will be appreciated that certain embodiments, or portions thereof, can also be oriented in other positions. In addition, the term "about" should generally be understood to refer to both the corresponding number and a range of numbers. In addition, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A dunnage system for converting sheet material, comprising:

a converting station that includes:

a drum having a drum surface that has first and second axial sides;

first and second guides protruding adjacent to and extending radially from the drum surface on the first and second axial sides, the first guide associated with the drum to rotate with the drum surface, and the first and second guides being configured for guiding the sheet material onto the drum surface laterally between the axial sides, wherein at least one of the guides is convexly dished with respect to the drum surface;

a driving mechanism associated with the drum for rotating the drum; and a roller biased against the drum between the guides to grip the sheet material against the drum for pulling and converting the sheet material to provide dunnage material; and a cutting station disposed downstream of the converting station and configured for cutting lengths of the dunnage material.

2. The system of claim 1, wherein a diameter of the drum is greater than a diameter of the roller, and the guides have a height above the drum surface of at least a tenth of the drum diameter.

3. The system of claim 2, wherein the guide heights are at least about the radius of the roller.

4. The system of claim 1, wherein the both guides are convexly dished with respect to the drum surface.

5. The system of claim 1, wherein the guides have a diameter that is about at least 1.5 times a diameter of the drum.

6. The dunnage system of claim 1, wherein the second guide is associated with the drum to rotate with the drum surface.

7. The system of claim 1, wherein both the first and second guides are rotationally affixed to the drum.

8. A dunnage system for converting sheet material, comprising:

a converting station that includes:

a drum having a drum surface that has first and second axial sides;

first and second guides protruding adjacent to and extending radially from the drum surface on the first and second axial sides the first guide associated with the drum to rotate with the drum surface, and the first and second guides being configured for guiding the sheet material onto the drum surface laterally between the axial sides;

a driving mechanism associated with the drum for rotating the drum; and a roller held against the drum between the guides by a magnetic retaining mechanism to grip the sheet material against the drum for pulling and converting the sheet material to provide dunnage material; and a cutting station disposed downstream of the converting station and configured for cutting lengths of the dunnage material.

9. The system of claim 8, wherein the cutting includes a pivotable blade configured to swivel as it cuts through the dunnage material.

10. The system of claim 9, wherein the cutting station includes a blade actuator configured for actuating the blade for cutting the dunnage material, wherein the blade is resiliently biased on towards an initial pivotal position.

11. The system of claim 8, wherein the drum is free of a cutting element.

12. The dunnage system of claim 8, wherein the cutting station is operable independently of the drum to cut desired lengths of the dunnage material.

13. A dunnage system for converting sheet material, comprising:

a converting station that includes:

a drum having a drum surface that has first and second axial sides;

first and second guides protruding adjacent to and extending radially from the drum surface on the first and second axial sides, the first guide associated with the drum to rotate with the drum surface, and the first and second guides being configured for guiding the sheet material onto the drum surface laterally between the axial sides;

a driving mechanism associated with the drum for rotating the drum; and a roller biased against the drum between the guides to grip the sheet material against the drum for pulling and converting the sheet material to provide dunnage material;

a supply station configured for positioning a supply roll of the sheet material with respect to the converting station such that the sheet material is fed to the converting station coiled from inside the roll, the drum and roller being configured for flattening and pulling the coiled sheet material to provide the dunnage material, wherein the supply station includes a supply base configured for supporting the supply roll, the supply base being configured for allowing the supply roll to rotate axially as the sheet material is pulled therefrom; and a cutting station disposed downstream of the converting station and configured for cutting lengths of the dunnage material.

14. The system of claim 13, wherein the supply base is substantially freely rotatable to rotate with the supply roll.

15. The system of claim 14, further comprising a supply brake associated with the supply base for applying a resistance to the rotation of the supply roll for controlling the unwinding of the coiled sheet material.

16. A dunnage system for converting sheet material, comprising a converting station that includes:

a drum having a drum surface that has first and second axial sides;

first and second guides protruding adjacent the drum surface on the first axial sides, the first guide associated with the drum to rotate with the drum surface, and the first and second guides being configured for guiding the sheet material onto the drum surface;

a driving mechanism associated with the drum for rotating the drum; and a roller biased against the drum between the guides by a magnetic retaining mechanism to grip the sheet material against the drum for pulling and converting the sheet material to provide dunnage material.

17. The dunnage system of claim 16, further comprising a supply station configured for positioning a supply roll of the sheet material with respect to the converting station such that the sheet material is fed to the converting station coiled from inside the roll, the drum and roller being configured for flattening and pulling the coiled sheet material to provide the dunnage material.

18. The dunnage system of claim 17, wherein the supply station comprises a gripping member configured for engaging and gripping the outside of the supply roll for retaining the supply roll as the sheet material becomes depleted.

19. The system of claim 16, wherein the first guide is rotationally affixed to the drum.

20. The dunnage system of claim 16, wherein the magnetic retaining mechanism includes:

a first magnetic member associated with the roller; and a second magnetic member associated with the drum;

wherein the first magnetic member is magnetically coupled with the second magnetic member sufficiently to bias the roller against the drum.

21. A dunnage system for converting sheet material, comprising:

a converting station that includes:

a drum having a drum surface that has first and second axial sides;

guides protruding adjacent the drum surface on the first and second axial sides associated with the drum to rotate with the drum surface, and configured for guiding the sheet material onto the drum surface;

a driving mechanism associated with the drum for rotating the drum; and a roller biased against the drum between the guides and being held against the drum by a magnetic retaining mechanism to grip the sheet material against the drum for pulling and converting the sheet material to provide dunnage material.

22. A dunnage system for converting sheet material, comprising:

a converting station that includes:

a drum having a drum surface that has first and second axial sides;

guides protruding adjacent the drum surface on the first and second axial sides associated with the drum to rotate with the drum surface, and configured for guiding the sheet material onto the drum surface;

a driving mechanism associated with the drum for rotating the drum;

a roller biased against the drum between the guides to grip the sheet material against the drum for pulling and converting the sheet material to provide dunnage material; and a supply station configured for positioning a supply roll of the sheet material with respect to the converting station such that the sheet material is fed to the converting station coiled from inside the roll, the supply station comprising a gripping member configured for engaging and gripping the outside of the supply roll for retaining the supply roll as the sheet material becomes depleted.

23. The system of claim 22, wherein the gripping member comprises a barb configured to engage the outer surface of the supply roll, such that the outer surface can be pulled away from the barb when the roll is empty.

24. The system of claim 23, wherein the barb is flexible for automatically engaging the outer surface of the supply roll as the supply roll is positioned in the supply station.

25. The system of claim 22, further comprising the supply roll, which is enclosed in an outer wrapping, the gripping member configured for engaging the outer wrapping.

26. The system of claim 22, wherein the supply station includes a supply base configured for supporting the supply roll, the gripping member being positioned on the supply base, and the supply base being configured for allowing the supply roll to rotate axially as the sheet material is pulled therefrom.

27. The system of claim 22, wherein the supply station is configured to feed the coiled sheet material upwards to the converting station.

* * * * *